United States Patent [19]

Mielke

[11] Patent Number: 4,694,813

[45] Date of Patent: Sep. 22, 1987

[54] PISTON FOR INTERNAL COMBUSTION ENGINES

[75] Inventor: Siegfried Mielke, Neckarsulm, Fed. Rep. of Germany

[73] Assignee: Kolbenschmidt AG, Neckarsulm, Fed. Rep. of Germany

[21] Appl. No.: 698,289

[22] Filed: Feb. 5, 1985

[30] Foreign Application Priority Data

Feb. 8, 1984 [DE] Fed. Rep. of Germany ..... 3404284

[51] Int. Cl.[4] ..... F02F 3/12

[52] U.S. Cl. ..... 123/668; 29/156.5 R; 51/289 R; 92/223; 123/193 P

[58] Field of Search ..... 92/213, 222, 223, 224; 29/156.5 R; 51/289 R, 290; 427/34; 123/668, 669, 193 P

[56] References Cited

U.S. PATENT DOCUMENTS

| | | | |
|---|---|---|---|
| 2,577,818 | 12/1951 | Shaw | 51/290 |
| 2,833,264 | 5/1958 | Dailey et al. | 92/224 |
| 3,019,277 | 1/1962 | Rudy | 123/668 |
| 4,074,671 | 2/1978 | Pennila | 92/223 |
| 4,398,527 | 8/1983 | Rynbrandt | 123/193 P X |
| 4,405,660 | 9/1983 | Ulion et al. | 427/34 |
| 4,495,907 | 1/1985 | Kamo | 123/669 X |
| 4,569,889 | 2/1986 | Przybyszewski et al. | 428/612 |
| 4,612,880 | 9/1986 | Brass et al. | 123/668 X |

FOREIGN PATENT DOCUMENTS

| | | | |
|---|---|---|---|
| 92532 | 10/1983 | European Pat. Off. | 123/668 |
| 1460183 | 11/1966 | France | 92/223 |

*Primary Examiner*—Tony M. Argenbright

*Attorney, Agent, or Firm*—Sprung Horn Kramer & Woods

[57] ABSTRACT

In a piston for internal combustion engines, a cover layer comprising a material having a relatively low thermal conductivity has been applied to the piston head by plasma or flame spraying. To increase the life of the cover layer until it separates from the body of the piston, the surface of the cover layer has a peak-to-valley height of 5 to 30 μm.

6 Claims, 3 Drawing Figures

RZ 46.2 YM
R3Z 19.2 YM
RA 8.58YM
RT 61.6 YM

RZ 15.2YM
R3Z 9.84YM
RA 2.44YM
RT 21.9 YM

PISTON FOR INTERNAL COMBUSTION ENGINES

BACKGROUND OF THE INVENTION

1. Field of the Invention

This invention relates to a piston for internal combustion engines, comprising a cover layer which has been applied to the piston head by plasma spraying or flame spraying and comprises a material having a relatively low thermal conductivity, preferably $\lambda \leqq 2$ W/mK.

2. Discussion of Prior Art

The requirements for lower fuel consumption and lower emission of polluants in the exhaust gases of internal combustion engines have resulted, for example, in diesel engines, in the use of a higher brake mean effective pressure (output, torque). This has been accomplished in many cases by the provision of an exhaust-driven supercharger. The high output of the engine per unit of displacement results in a high heat loading of the piston requiring increased cooling of the piston to maintain the piston's stength and function. Increased cooling is, however, inconsistent with the requirement to reduce the dissipation of heat generated by the combustion process to the coolant and to the lubricating oil. The latter requirement is due to the following reasons:

A. If the quantities of lubricating oil and of coolant and the size of the radiator can be reduced, less power is required to drive the fan.

B. The higher exhaust gas temperature can be utilized in the supercharged engine to reduce the fuel consumption.

C. The improved evaporation of the fuel spread over the wall of the hot piston head improves the quality of the exhaust gas, particularly when the engine is warming up.

On the other hand, by decreasing the extent to which heat is dissipated by the coolant, a high heat loading of the piston head results so that the piston must be heat-insulated.

Various kinds of insulated piston heads have been proposed. For instance, an aluminum piston having a screw-connected ceramic head which is insulated from the skirt by steel discs has been described and investigated by J. H. Stang in "Designing Adiabatic Engine Components, SEA 780,069. A temperature of about 900° C. can be reached at the piston head of such aluminum piston. However, the so-called hot piston which results is obtained only by the use of a ceramic top having the required strength, such ceramic tops are expensive, additionally the volume of the dead space disposed above the first piston ring is relatively large so that the composition of the exhaust gas can be adversely affected.

It is also known to heat-insulate the surface of the piston head from the body of the piston for an internal combustion engine by providing a protecting cover layer containing zirconium oxide, zirconium silicate, cermets or the like. These can be applied by plasma or flame spraying in a thickness of 0.5 to 3 mm to provide a covering layer having a peak-to-valley height of 50 to 100 μm.

An important disadvantage of that heat-insulating cover layer resides in that when a sufficiently thick covering layer is applied to the piston, the layer's adhesion to the materials which constitute the body of the piston is not ensured under all loading conditions so that the cover layer has a sufficiently long life before the cover layer separates from the body of the piston. This is due to the high heat loading of the cover layer, particularly to the frequent changes of temperature, by which the cover layer is gradually weakened resulting in the formation of cracks. This is also due to the large temperature gradient which is set up in the cover layer giving rise to correspondingly high stresses.

SUMMARY OF THE INVENTION

It is an object of the present invention, therefore, to provide a piston which is of the kind described first hereinbefore and intended for use in internal combustion engines and in which the cover layer applied to the piston by plasma or flame spraying is so designed that its bond strength is greatly increased so that its life until the cover layer separates from the piston is greatly prolonged.

This object is accomplished in that the cover layer has a thickness of 0.5 to 2 mm and a peak-to-valley height of only 5 to 30 μm, preferably 10 to 25 μm. As a result, the surface has virtually no peaks and its peak-to-valley height can be compared to that of surfaces which have been machined to a microfinish. A waviness of the surface as a second order form error is permissible.

Preferable, the cover layer is made of a material of low thermal conductivity, e.g., one whose thermal conductivity is $\lambda \leqq 2$ W/mK.

wherein $\lambda$ = thermal coefficient

W = heat flow (Watt)

m = length (meter)

K. = temperature (Kelvin)

The cover layer comprises, suitably, partly or fully stabilized zirconium oxide.

Owing to the morphological design of the surface of the cover layer provided in accordance with the invention, the life of the cover layer is advantageously at least doubled because its thermal loading is distinctly decreased as a result of the decrease of its heat transfer surface area so that its thermal load-carrying capacity is increased. Owing to the comparatively higher finish of the surface of the cover layer, the turbulence in the gas layer adjoining the cover layer is also reduced to such a degree that a temperature gradient is obtained in the combustion gas. Additionally, an additional heat-insulation is provided by stationary gas cushions formed in the valleys. Finally, the thermal conductivity of the cover layer is reduced and its effectiveness is improved.

Respectively a piston head with a cover layer of zirconium oxide before and after machining to a high finish has been subjected to a temperature cycle of heating up to 1000° C. within 15 s and cooling down to room temperature within 40 s. The unmachined cover layer chipped off from the piston head after 1000 temperature cycles whilst the highly finished cover layer chipped of after 2500 temperature cycles. The number of temperature cycles is proportional with the life of the cover layer.

The cover layer may be provided with the surface designed in accordance with the invention by all conventional methods of machining surfaces to a high finish, provided that they do not involve a point loading of the cover layer. Especially the sprayed cover layer will be highly finished by precision turning with a diamond tool.

BRIEF DESCRIPTION OF DRAWINGS

The invention is shown, by way of example, in the drawings and will now be described more in detail.

Figure 1:
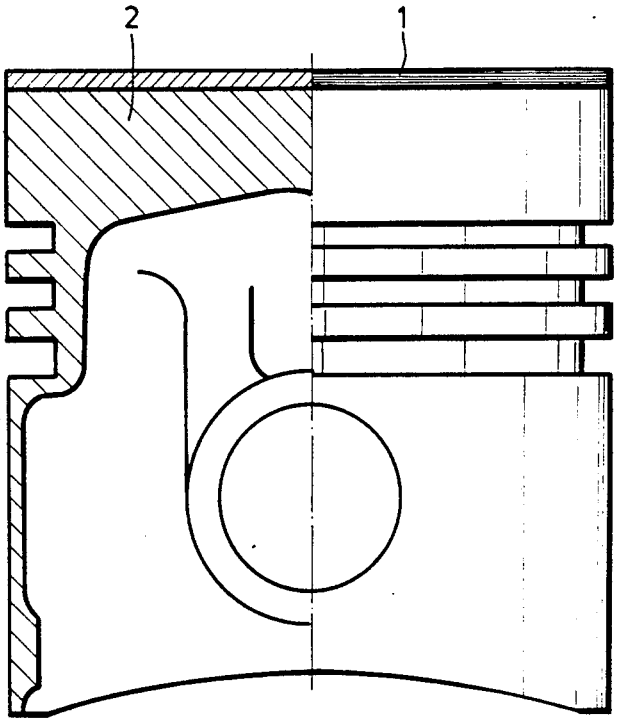
FIG. 1 is a front elevation and a partial longitudinal sectional view through the pressure-counter-pressure plane and shows a light alloy piston casting which consists of an aluminum alloy and has been provided on its piston head 2 with a cover layer 1, which has a thickness of 1.5 mm and consists of zirconium oxide and has been applied by conventional plasma spraying.
Figure 2:
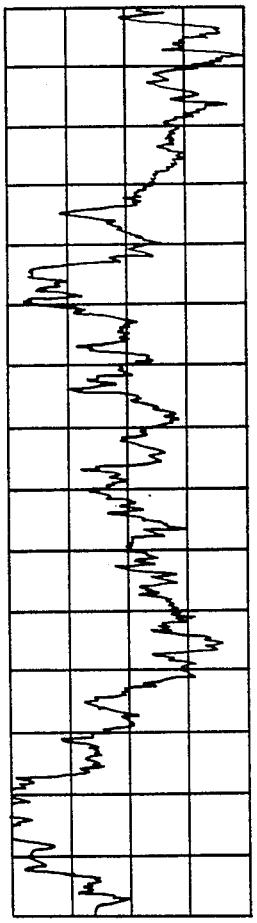
FIG. 2 shows the profile of the finish of the surface of the cover layer 1 before the surface has been machined toa high finish and FIG. 3 shows that profile after that machining. The finish-defining parameters $R_Z$ (mean peak-to-valley height), $R_{Z3}$ (maximum peak-to-valley height), $R_A$ (arithmetic mean of roughness) and $R_t$ (peak-to-valley height) are stated over the profiles. $R_Z$, $R_{Z3}$, $R_A$, and the peak-to-valley height $R_t$ are stated over the profiles.
Figure 3:
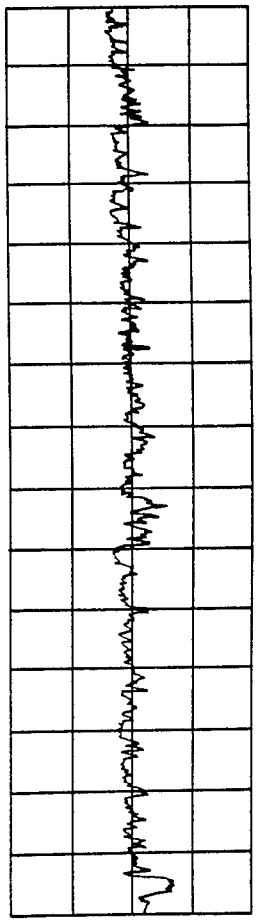

In accordance with DIN 4768, issue of August 1974, $R_Z$ is the average peak-to-valley height, which is defined as the arithmetic mean of the individual peak-to-valley heights of five adjoining parts of a section under consideration, $R_{Z3}$, is the largest individual peak-to-valley height, which is defined as the largest individual peak-to-valley height measured in a section under consideration, and $R_A$ is the mean excursion from the median line and is defined as the arithmetic mean of the absolute amounts of the excursion from the median line of the section being considered.

What is claimed is:

1. In a piston for an internal combustion engine, comprising a cover layer which has been applied to the piston head by plasma spraying or flame spraying and consists of a material having a relatively low thermal conductivity, the improvement wherein said cover layer comprises a material of thermal conductivity of $\lambda \leqq 2$ W/mK., and has a thickness of 0.5 to 2 mm and a peak-to-valley height of only 5 to 30 $\mu$m.

2. A piston according to claim 1, wherein the cover layer 1 comprises partly or fully stabilized zirconium oxide.

3. A piston according to claim 1, wherein said peak-to-valley height is 10–25 $\mu$m.

4. A process of manufacturing a piston for an internal combustion engine, comprising a cover layer which has been applied to the piston head by plasma spraying or flame spraying and consists of a material having a relatively low thermal conductivity, wherein said cover layer has a thickness of 0.5 to 2 mm and a peak-to-valley height of only 5 to 30 $\mu$m which comprises machining the cover layer on the piston head to a peak-to-valley height of 5 to 30 $\mu$m.

5. In an internal combustion engine comprising a piston and a cylinder, the improvement wherein said piston comprises a cover layer which has been applied to the piston head by plasma spraying or flame spraying and which consists of a material having a relatively low thermal conductivity wherein said cover layer comprises a material of thermal conductivity of $\lambda \leqq 2$ W/mK., and has a thickness of 0.5 to 2 mm and a peak-to-valley height of only 5 to 30 $\mu$m.

6. An internal combustion engine according to claim 5 wherein said engine is a diesel engine.

* * * * *